United States Patent [19]

Schabernack et al.

[11] 3,947,348

[45] Mar. 30, 1976

[54] MAKING OF A WAVE GUIDE

[75] Inventors: Paul Schabernack, Breitscheidt; Wolfgang von Jan, Windeck, both of Germany

[73] Assignee: Kabel-und Metallwerke Gutehoffnungshutte AG, Hannover, Germany

[22] Filed: June 26, 1974

[21] Appl. No.: 483,118

[30] Foreign Application Priority Data

July 11, 1973 Germany ..... 2335206

[52] U.S. Cl. ..... 204/9; 204/4

[51] Int. Cl.[2] ..... C25D 1/02; C25D 1/00

[58] Field of Search ..... 204/4, 3, 9

[56] References Cited

FOREIGN PATENTS OR APPLICATIONS 4,499 1885 United Kingdom ..... 204/9

OTHER PUBLICATIONS

*Electronics* Sept. 11, 1959, pp. 114–117.

*Primary Examiner*—T. M. Tufariello

*Attorney, Agent, or Firm*—Ralf H. Siegemund

[57] ABSTRACT

A method of making a wave guide by electrolytically depositing copper on a mandrel is improved by using, e.g., a nickel steel mandrel having a thermal coefficient of expansion about one-tenth or less of that of copper. After plating, the assembly is heated so that the copper tube separates from the mandrel without sticking, and can be taken off without exercise of undue force, which could damage mandrel or tube.

6 Claims, 1 Drawing Figure

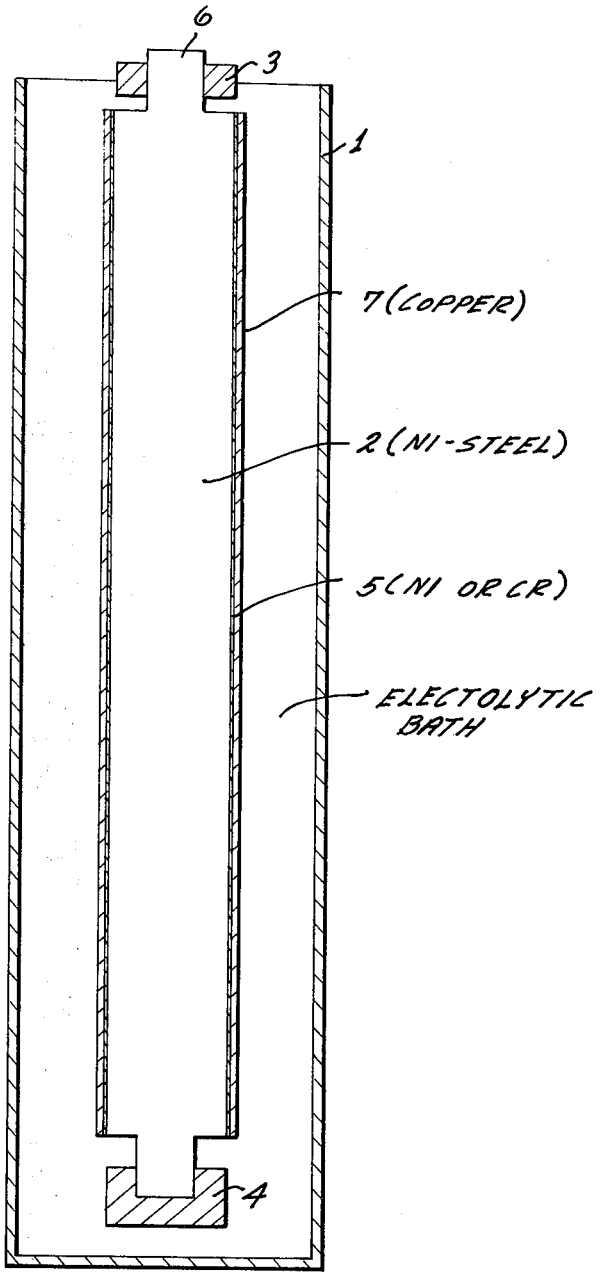
6
3
1
7(COPPER)
2(NI-STEEL)
5(NI OR CR)
ELECTOLYTIC BATH
4

MAKING OF A WAVE GUIDE

BACKGROUND OF THE INVENTION

The present invention relates to wave guides such as wave guides with circular cross-section to be used for the transmission of electrical high frequency signals in the $H_{01}$ mode and over long distances.

Wave guides of this type are made for example by electrolytically depositing an electrically conductive metal onto a very accurately machined mandrel having the desired contour. Another tube is provided around the tube as resulting from the electrolytic process, and the space between these tubes is filled with an electrically insulating material. A wave guide made in such a manner has a smooth inner surface, accurately dimensioned circular cross-section, and when used in straight path of conduction, this wave guide is indeed suitable for transmission of wide band $H_{01}$ type waves.

It is also known to use a corrugated jacket as the outer tube, and plastic is injected into the space and cured for hardening. The wave guide proper results from galvanically depositing, e.g., copper on a cylindrically, ground steel mandrel with fine surface finish as the mandrel or die surface condition will determine the smoothness of the wave guide. The peak to valley weight of any residual surface roughness must be quite small. A wave guide made in that manner may be several meters long. The resulting wave guide, particularly when provided with a corrugated outer jacket is a satisfactory product. However, it is quite difficult to separate the tube made by the electrolytic process from the mandrel (see German printed patent application No. 1,640,739).

DESCRIPTION OF THE INVENTION

It is an object of the present invention to improve the method of making a wave guide by means of electrolytically depositing conductive material on a mandrel and to facilitate particularly the separation of the resulting tube from the mandrel.

In accordance with the present invention it is suggested to use a mandrel made of a material having a coefficient of thermal expansion which is significantly smaller than such a coefficient for the metal to be electrodeposited on the mandrel. Upon completion of the electrolytic tube making, the tube is heated so that it separates from the mandrel, and the mandrel is then removed from the interior of the expanded tube.

By way of example the mandrel may be made of steel having 33 to 38% nickel. This type of steel is traded under the designation "invar" and has a coefficient of thermal expansion ranging from 0.8 to $2 \cdot 10^{-6}$ while copper that has been electrolytically precipitated has a coefficient of $16 \cdot 10^{-6}$, i.e., approximately one order of magnitude higher than the coefficient for "invar" steel. Preferably, the mandrel has been prepared in that a thin surface layer of nickel or chromium has been electrolytically deposited and passivated prior to use as a die in an electrolytic bath for the stated purpose. Such a mandrel surface permits particularly easy separation of the copper tube after having been made by electrolytically depositing copper on the mandrel.

After such a tube has been made the assembly is removed from the electrolytic bath and heated, e.g., to 100°C or above, preferably about 140° to 160°C. Actually, heating may be limited to the copper tube, but thermal conduction into the mandrel cannot be avoided, copper is quite a good heat conductor. In any event, the copper tube expands more than the steel mandrel without damage to either surface, and the tube can readily be taken off the mandrel subsequently.

Particularly, for large copper tubes it is of advantage to orient the mandrel in a vertical disposition so that the mandrel will not bend under its own weight. Also, removal of the tube in a vertical disposition will avoid bending of the tube.

DESCRIPTION OF THE DRAWINGS

While the specification concludes with claims particularly pointing out and distinctly claiming the subject matter which is regarded as the invention, it is believed that the invention, objects and features of the invention and further objects, features and advantages thereof will be better understood from the following description taken in connection with the accompanying drawings in which:

The FIGURE shows equipment in cross-section for practicing the inventive method.

Proceeding now to the detailed description of the drawings, the FIGURE shows a tank or vessel 1 containing an electrolytic liquid, as commonly used for electrically depositing copper on a substrate. A mandrel 2 is vertically suspended in the vessel in that particularly bearings 3 and 4 are provided for journalling axles 6 and 6' of the mandrel 2 so that the mandrel can undergo rotation during electroplating.

The mandrel is of cylindrical configuration and made of steel having 33 to 38% Ni. The mandrel has been ground to have accurately circular periphery in cross-section transverse to the plane of the drawing. The nickel-steel mandrel body has been provided with a thin surface layer 5 of nickel, deposited on the mandrel previously and also by electrolytic process.

Prior to insertion into tank 1 the mandrel has been greased and rinsed in water. After installation and during the copper plating process mandrel 2 rotates and is connected to a source of voltage potential to serve as cathode. The upper journal shaft 6 may serve for connection to a mandrel drive (not shown) as well as for making the required electrical connection.

The bath in tank 1 is filled with an electrolytic liquid as is commonly used for copper plating, and anodes are placed around the mandrel. The front ends of mandrel 2 as well as axles 6 and 6' are covered with an electric insulator so that copper will not be deposited thereon, but will precipitate only onto the cylindrical periphery of the mandrel. As the electrolytic process proceeds, copper is deposited on the mandrel, forming a tube 7.

After the electroplating process has been run for a specified period of time to obtain a tube 7 of desired thickness, mandrel 2 with tube 7 are removed from the tank and dipped, e.g., in a bath of heating fluid or placed into a furnace. The copper tube will be the immediate recipient of thermal energy, but will conduct heat into the mandrel. Nevertheless, the tube will expand more than the mandrel and soon begins to separate therefrom. As a consequence a gap forms as between copper tube and steel mandrel, impeding the heat transfer so that the copper tube will be heated more and expand more etc. If the heating process causes the tube to assume a temperature of about 140° to 150° C. only, heating is not excessive and the separation will occur rather gently. Hence, the tube's inner surface as well as the mandrel surface will not be damaged.

Heating should persist generally until the radially effective differences in thermal expansion of mandrel and tube have resulted in a gap of about 0.1 mm.

The mandrel can now readily be taken out of the tube 7 and can be reused many times. The tube 7 may, for example, have a wall thickness of about 1mm and a length of 5 meters. That tube will then be jacketed with a corrugated tube, and the space between tube 7 and corrugated jacket or envelope is filled with an isolating material, such as a curable synthetic resin.

Prior to heating, the mandrel with copper tube still attached may be dipped into a different bath cooperating with a different set of anodes for electroplating the tube 7, e.g., with nickel or cobalt or Ni/Co-alloy, which is mechanically stronger than copper, so that the resulting two layer tube has greater mechanical strength. The resulting outer layer will expand to a slightly different degree as the copper which was deposited first. However, the resulting overall of expansion of the copper - nickel / cobalt tube will not be sufficiently significant to produce any stress problem. Moreover, the process covers quite a small range so that the dimensions are completely reproducible on account of complete reversability of the thermal expansion upon subsequent cooling.

The invention is not limited to the embodiment described above but all changes and modifications thereof not constituting departures from the spirit and scope of the invention are intended to be included. Such modifications involve particularly other, non-circular cross-sections for the wave guide to be made.

We claim:

1. In a method for making a wave guide of cylindrical inner surface of accurate cross-section by means of electrolytically depositing material on a mandrel for forming a tube thereon to be removed from the mandrel, the improvement comprising:

using a mandrel made of steel having 33 to 38% nickel for having a coefficient of thermal expansion sufficiently smaller than the coefficient of thermal expansion of the material as deposited on the mandrel;

disposing the mandrel in a vertical disposition during the depositing; and heating the tube as made subsequently to the electrolytic depositing until the mandrel separates completely from the tube permitting removal of the mandrel from the interior of the tube.

2. In a method as in claim 1, wherein the coefficients of thermal expansion are apart by at least about one-half order of magnitude.

3. In a method as in claim 1, wherein the tube is heated to a temperature in excess of about 100°C.

4. In a method as in claim 1, wherein a thin chromium or nickel layer has been provided on the mandrel.

5. In a method as in claim 1, wherein copper is electrolytically deposited on the mandrel.

6. In a method as in claim 5, wherein a material of higher mechanical strength than copper is subsequently deposited on the copper as previously deposited, but prior to said heating.

* * * * *